US010982880B1

(12) United States Patent
Traeger

(10) Patent No.: US 10,982,880 B1
(45) **Date of Patent: *Apr. 20, 2021**

(54) HIGH-CAPACITY SPARKLESS MOBILE DOUBLE-INSULATED WOOD PELLET BURNER UNIT

(71) Applicant: ORIGINAL PELLET GRILL COMPANY, LLC, Mount Angel, OR (US)

(72) Inventor: Joe Traeger, Mount Angel, OR (US)

(73) Assignee: Original Pellet Grill Company LLC, Mount Angel, OR (US)

( * ) Notice: Subject to any disclaimer, the term of this patent is extended or adjusted under 35 U.S.C. 154(b) by 68 days.

This patent is subject to a terminal disclaimer.

(21) Appl. No.: 16/253,636

(22) Filed: Jan. 22, 2019

Related U.S. Application Data

(63) Continuation of application No. 15/178,357, filed on Jun. 9, 2016, now Pat. No. 10,222,092.

(60) Provisional application No. 62/175,944, filed on Jun. 15, 2015.

(51) Int. Cl.
*F24H 3/00* (2006.01)
*F24B 13/00* (2006.01)

(52) U.S. Cl.
CPC ..... *F24H 3/008* (2013.01); *F24B 13/002* (2013.01)

(58) Field of Classification Search
CPC ..... F24B 1/19; F24B 1/181; F24H 3/008
USPC ..... 126/109, 519
See application file for complete search history.

(56) References Cited

U.S. PATENT DOCUMENTS

| | | | |
|---|---|---|---|
| 3,079,909 | A | 3/1963 | Bemben |
| 3,200,806 | A | 8/1965 | Arnold |
| 3,220,400 | A | 11/1965 | Yager |
| 3,339,540 | A | 9/1967 | Kreider |
| 3,359,968 | A | 12/1967 | Thulman |
| 3,515,117 | A | 6/1970 | Gene |
| 3,809,058 | A | 5/1974 | Becker |
| 5,421,321 | A | 6/1995 | Ward |

(Continued)

FOREIGN PATENT DOCUMENTS

| | | | |
|---|---|---|---|
| DE | 202006016487 | U1 | 2/2008 |
| GB | 821175 | A | 9/1959 |
| GB | 2480449 | A | 11/2011 |

*Primary Examiner* — Steven B McAllister
*Assistant Examiner* — Aaron H Heyamoto
(74) *Attorney, Agent, or Firm* — Renaissance IP Law Group; David A. Crowther

(57) ABSTRACT

Embodiments of the inventive concept provide a high-capacity, sparkless, mobile, double-insulated wood pellet burner unit. The wood pellet burner unit is safely operated on a wood floor or deck. The wood pellet burner unit produces a large radiant flame that enhances the surrounding area, free from dangerous sparks and smoke. The ash and coals from the fire are enclosed within a double-insulated housing. A wind break radiant heat reflector protects the flame from being distorted, enhances the flame so that it remains in a substantially upright column, and reflects some of the heat outwardly toward the users. Casters disposed on the bottom of the wood pellet burner permit easy and convenient movement of the unit. The wood pellet burner unit disclosed herein produces a larger and fuller flame than a pure gas fire pit based on a balanced multi-directional flow of heated combustion air flow through the unit.

15 Claims, 9 Drawing Sheets

(56) References Cited

U.S. PATENT DOCUMENTS

| | | | | |
|---|---|---|---|---|
| 5,797,386 | A * | 8/1998 | Orr | A47J 37/0704 126/25 A |
| 6,422,134 | B1 * | 7/2002 | Barksdale | A47J 37/0704 126/25 R |
| 6,615,821 | B1 * | 9/2003 | Fisenko | A47J 37/0704 126/15 R |
| 6,769,907 | B2 | 8/2004 | Doud | |
| 8,028,690 | B1 | 10/2011 | Lohaus | |
| 8,535,052 | B2 | 9/2013 | Cadima | |
| D701,721 | S | 4/2014 | Jan | |
| 8,776,777 | B2 | 7/2014 | Jin et al. | |
| 2003/0194671 | A1 | 10/2003 | Webb | |
| 2007/0224560 | A1 | 9/2007 | Stainrod et al. | |
| 2008/0163863 | A1 * | 7/2008 | Thomas | F24B 1/1957 126/512 |
| 2008/0267750 | A1 * | 10/2008 | Bramhall | A21B 1/245 414/331.06 |
| 2009/0165772 | A1 * | 7/2009 | Hunt | A47J 36/26 126/25 R |
| 2012/0006316 | A1 | 1/2012 | Shimek et al. | |
| 2013/0288189 | A1 | 10/2013 | White | |
| 2014/0238378 | A1 | 8/2014 | Scott | |

* cited by examiner

HIGH-CAPACITY SPARKLESS MOBILE DOUBLE-INSULATED WOOD PELLET BURNER UNIT

RELATED APPLICATION DATA

This application is a continuation of U.S. application Ser. No. 15/178,357, filed on Jun. 9, 2016, which claims the benefit of commonly-owned U.S. Provisional Patent Application Ser. No. 62/175,944, filed on Jun. 15, 2015, which are hereby incorporated by reference.

TECHNICAL FIELD

This application pertains to wood pellet fire pits, and more particularly, to a high-capacity, sparkless, mobile, double-insulated wood pellet burner unit.

BACKGROUND

Wood burning fire pits are popular among outdoor enthusiasts. The smells, warmth, and ambiance provided by such fire pits enhance social and family gatherings. Quite often, such fire pits are installed in back yards or on decks. However, conventional wood fire pits tend to generate copious amounts of smoke and sparks, which can be unpleasant, and in some cases, dangerous. When installed or set atop an outdoor wooden deck, the risk of causing unwanted fire outside of the fire pit increases even more, as the heat and sparks can create a fire hazard. Moreover, conventional fire pits are deficient in areas of capacity, flame reliability, and effective burning methods, which can lead to disappointment and a reluctance on the part of owners to use such fire pits.

Accordingly, a need remains for an improved wood pellet burner unit that has high-capacity, sparkless, mobile, and double-insulated features. Embodiments of the inventive concept address these and other limitations in the prior art.

Figure 1:
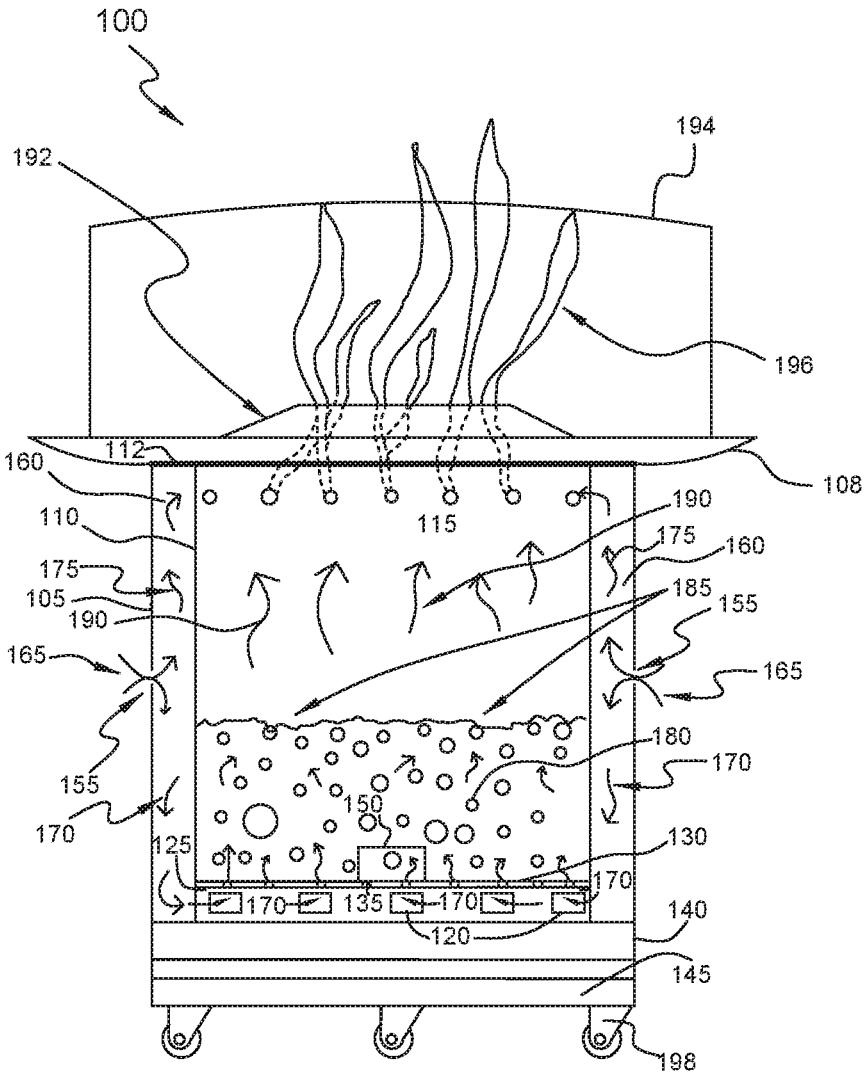
FIG. 1 illustrates an example cross-sectional side elevation view block diagram of an example wood pellet burner unit in accordance with various embodiments of the inventive concept.

The foregoing and other features of the inventive concept will become more readily apparent from the following detailed description, which proceeds with reference to the accompanying drawings.

DETAILED DESCRIPTION OF THE EMBODIMENTS

Reference will now be made in detail to embodiments of the inventive concept, examples of which are illustrated in the accompanying drawings. The accompanying drawings are not necessarily drawn to scale. In the following detailed description, numerous specific details are set forth to enable a thorough understanding of the inventive concept. It should be understood, however, that persons having ordinary skill in the art may practice the inventive concept without these specific details. In other instances, well-known methods, procedures, components, circuits, and networks have not been described in detail so as not to unnecessarily obscure aspects of the embodiments.

It will be understood that, although the terms first, second, etc. may be used herein to describe various elements, these elements should not be limited by these terms. These terms are only used to distinguish one element from another. For example, a first unit could be termed a second unit, and, similarly, a second unit could be termed a first unit, without departing from the scope of the inventive concept.

It will be understood that when an element or layer is referred to as being "on," "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

The terminology used in the description of the inventive concept herein is for the purpose of describing particular embodiments only and is not intended to be limiting of the inventive concept. As used in the description of the inventive concept and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the inventive concept provide a high-capacity, sparkless, mobile, double-insulated wood pellet burner unit. The wood pellet burner unit disclosed herein can be safely operated on a wood floor or deck. Up to forty (40) pounds of wood pellets can be held within the wood pellet burner and burn for up to three hours, or thereabout. The wood pellet burner unit disclosed herein produces a large radiant flame that enhances the surrounding area, free from dangerous sparks and smoke. The ash and coals from the fire are enclosed within a double-insulated housing such that the wind cannot blow sparks out of the unit. The double-insulated aspect provides further fire safety and protection from accidents. A wind break radiant heat reflector protects the flame from being distorted, enhances the flame so that it remains in a substantially upright column, and reflects some of the heat outwardly toward the users. Casters disposed on the bottom of the wood pellet burner permit easy and convenient movement of the unit. The wood pellet burner unit disclosed herein produces a larger and fuller flame than a pure gas fire pit based on a balanced multi-directional flow of heated combustion air flow through the unit, as further described in detail below.

FIG. 1 illustrates an example block diagram of an example wood pellet burner unit 100 in accordance with various embodiments of the inventive concept. The wood pellet burner unit 100 can include an outer housing 105. The outer housing 105 can be substantially cylindrical in form. It will be understood, however, that in some embodiments, the outer housing 105 can be rectangular, box-shaped, cone-shaped, pyramid-shaped, or the like. A removable inner combustion vessel 110 can be inserted into and removed from the outer housing 105. The inner combustion vessel 110 can include upper vessel orifices 115 and lower vessel apertures 120. The upper vessel orifices 115 can be generally circular in form, and can be disposed around the circumference of an upper region of the inner combustion vessel 110. It will be understood that other suitable orifices besides circular orifices can be disposed in the upper region of the inner combustion vessel 110. The lower vessel apertures 120 can be generally rectangular in form and can be disposed around the circumference of a lower region of the inner combustion vessel 110. It will be understood that other suitable apertures besides rectangular apertures can be disposed in the lower region of the inner combustion vessel 110. In some embodiments, the lower vessel apertures 120 can be individually and/or collectively larger than the upper vessel orifices 115. For example, the area of the opening of each lower vessel aperture can be larger than the area of opening of each upper vessel orifice. This size difference compensates for the additional path of resistance that must be traveled by the combustible air 170 through the wood pellets 180. In some embodiments, the upper vessel orifices 115 can be greater in number than the lower vessel apertures 120.

The inner combustion vessel 110 can include a grate support flange 125. The grate support flange 125 can be an annular grate support flange 125. The grate support flange 125 extends inwardly from a wall of the inner combustion vessel 110, and is located in a lower section of the inner combustion vessel 110, but above a bottom end of the inner combustion vessel 110 and below a mid-section of the inner combustion vessel 110. The lower vessel apertures 120 can be disposed at or beneath the grate support flange 125. For example, the lower vessel apertures 120 can extend from about the same height as the grate support flange 125 to about a top surface of a lower inner insulation layer 140 disposed beneath the inner combustion vessel 110. The grate support flange 125 can support a removable grate 130. For example, the grate 130 can be inserted into the inner combustion vessel 110 such that it rests atop the grate support flange 125. Moreover, the grate 130 can be removed from the inner combustion vessel 110. The grate 130 can include a handle 150 to facilitate the insertion and removal of the grate into and out from the inner combustion vessel 110. The grate 130 can include grate orifices 135. The grate orifices 135 can be spaced apart and distributed throughout the grate 130. The grate orifices 135 can be circular in form, although it will be understood that the grate orifices 135 can take other suitable forms. Wood pellets 180 can be disposed on the grate 130. The grate orifices 135 can be of a suitable size such that air can freely flow through the grate 130 in an upward direction while minimizing or preventing the wood pellets 180 from falling through the grate 130.

The inner combustion vessel 110 can include an upper resting flange 112. The upper resting flange 112 can be an annular upper resting flange 112. The upper resting flange 112 can rest atop the outer housing 105, thereby providing support to the inner combustion vessel 110. The upper resting flange 112 extends outwardly from the inner combustion vessel 110, and can be substantially flush with a top end of the inner combustion vessel 110. The inner combustion vessel 110 can be lifted off of the outer housing 105 using the upper resting flange 112. In addition, the inner combustion vessel 110 can be placed back within the outer housing 105 such that the upper resting flange 112 makes contact with an upper portion of the outer housing 105, and such that the inner combustion vessel 110 is disposed within the outer housing 105, with an air gap 160 substantially separating the inner combustion vessel 110 from the outer housing 105.

The inner combustion vessel 110 can include the inner insulation layer 140. The inner insulation layer 140 can insulate the inner combustion vessel 110 from the outer housing 105. In other words, the inner insulation layer 140 can act as a heat barrier to slow the dispersion of outward and downward radiant heat, thereby reducing or eliminating a fire hazard associated with operating the wood pellet burner unit 100 on wood floors, combustible surfaces, and/or other surfaces susceptible to melting or damage. The outer housing 105 can include an outer insulation layer 145 that is spaced apart from the inner insulation layer 140. In some embodiments, the outer housing 105 can be disposed on the outer insulation layer 145. The outer insulation layer 145 provides another heat barrier to slow the dispersion of outward and downward radiant heat, thereby further reducing or eliminating the fire hazard. The temperature of floors and other supporting surfaces upon which the wood pellet burner unit 100 can be placed can be maintained at or below 100 degrees Fahrenheit due at least in part to the dual-insulation feature.

The inner combustion vessel 110 can be made of any suitable metal, amalgam, ceramic, or the like. The outer housing 105 can be made of any suitable metal, amalgam, ceramic, or the like. The inner insulation layer 140 can be made of any suitable high-temperature insulative material. The outer insulation layer 145 can be made of any suitable high-temperature insulative material.

The outer housing 105 can include air intake vents 155. The air intake vents 155 can vent outside air 165 into the outer housing 105. The air intake vents 155 can be disposed about midway between the top of the outer housing 105 and the bottom of the outer housing 105. In some embodiments, the air intake vents 155 can be disposed below the midway point between the top of the outer housing 105 and the bottom of the outer housing 105. In some embodiments, the air intake vents 155 can be disposed above the midway point between the top of the outer housing 105 and the bottom of the outer housing 105. In some embodiments, the air intake vents 155 can be in the form of slits. An air gap 160 can exist between the outer housing 105 and the inner combustion vessel 110. The air gap 160 can channel the outside air 165 along two different branches, i.e., in a downward direction and an upward direction. For example, the outside air 165 can be divided into a first branch that includes downward flowing heated combustible air 170 and a second branch that includes upward flowing heated combustible air 175. The downward flowing heated combustible air 170 and the upward flowing heated combustible air 175 can be heated by radiant heat from walls of the inner combustion vessel 110.

The downward flowing heated combustible air 170 can be guided down the air gap 160, through the lower vessel apertures 120 of the inner combustion vessel 110, and up through the wood pellets 180. In this manner, the heated combustible air 170 taking the first branch can be mixed with the burning wood pellets 180, thereby forming a gasification 185 of the wood pellets 180. Wood pellet gases 190 can be formed as a result of the gasification 185 of the wood pellets 180.

In the meanwhile, the upward flowing heated combustible air 175 can be guided up the air gap 160, through the upper vessel orifices 115, thereby mixing with the wood pellet gases 190. Before a sufficient amount of wood pellet gases 190 are present within the inner combustion vessel 110, flames 196 are generated, but the base of the flames 196 is at or near the wood pellets 180 themselves (not shown). As a sufficient amount of wood pellet gases 190 accumulate within the inner combustion vessel 110, the base of the flames 196 shifts upward so that it is at or near the upper vessel orifices 115 on the inside of the inner combustion vessel 110, as shown in FIG. 1, thereby achieving a gasification combustion through the upper vessel orifices 115.

In this operating state, the wood pellet burner unit 100 produces tall and full flames 196 that are pleasurable and warm to the users of the unit 100. In this state, the flames 196 are devoid of sparks or any significant amount of smoke. The multi-path flow of the outside air 165 through the air gap 160 enables the tall and full flames 196 while also accommodating the dual-insulation construction of the wood pellet burner unit 100. Moreover, the air gap 160 itself provides additional insulation between the inner combustion vessel 110 and the outer housing 105, thereby reducing the outer temperature of the outer housing 105, increasing safety, and decreasing burn hazards.

The outer housing 105 can include an outer housing rim assembly 108. The outer housing rim assembly 108 can provide a safety barrier so that small children cannot access or touch the flames 196. A flame guide 192 can be set atop the outer housing 105 above the inner combustion vessel 110. The flame guide 192 can bring the wood pellet gases 190 and the upward flowing heated combustible air 175 together to achieve a complete combustion, thereby reducing or eliminating smoke. The flame guide 192 can be an annular flame guide 192, although it will be understood that the flame guide 192 can take other suitable forms.

A wind break radiant heat reflector 194 can be disposed on the outer housing rim assembly 108 of the outer housing 105. The wind break radiant heat reflector 194 can encircle substantially one half of the circumference of the outer housing rim assembly 108. The wind break radiant heat reflector 194 can enhance the flames 196 by shielding wind that can otherwise distort the flames 196. In addition, the wind break radiant heat reflector 194 can reflect heat inwardly toward the flames 196, thereby enhancing the quality of the flames 196 while also directing heat outwardly toward the users of the wood pellet burner unit 100. The wind break radiant heat reflector 194 can be 12 inches high, or thereabout. The wind break radiant heat reflector 194 can include a mirror-like finish on the inside that can reflect the heat from the flames 196. The wind break radiant heat reflector 194 can be situated or pointed toward the wind so that the wind is shielded from the flames 196.

The outer housing 105 can include casters 198, which make moving the wood pellet burner unit 100 simple and convenient. For example, three or more casters 198 can be attached beneath the outer housing 105. In some embodiments, the three or more casters 198 can be attached to the outer insulation layer 145. Stick wood (not shown) can be burned in the wood pellet burner unit 100 with or without the wood pellets 180. The wood pellet burner unit 100 can hold 40 pounds (lbs) of wood pellets 180, or thereabout, which can burn for over three (3) hours, or thereabout. For example, the inner combustion vessel 110 can accommodate up to 40 lbs of wood pellets 180 while still producing full and high-quality flames 196 via the multi-directional flow of heated combustion air flow through the unit.

Figure 2:
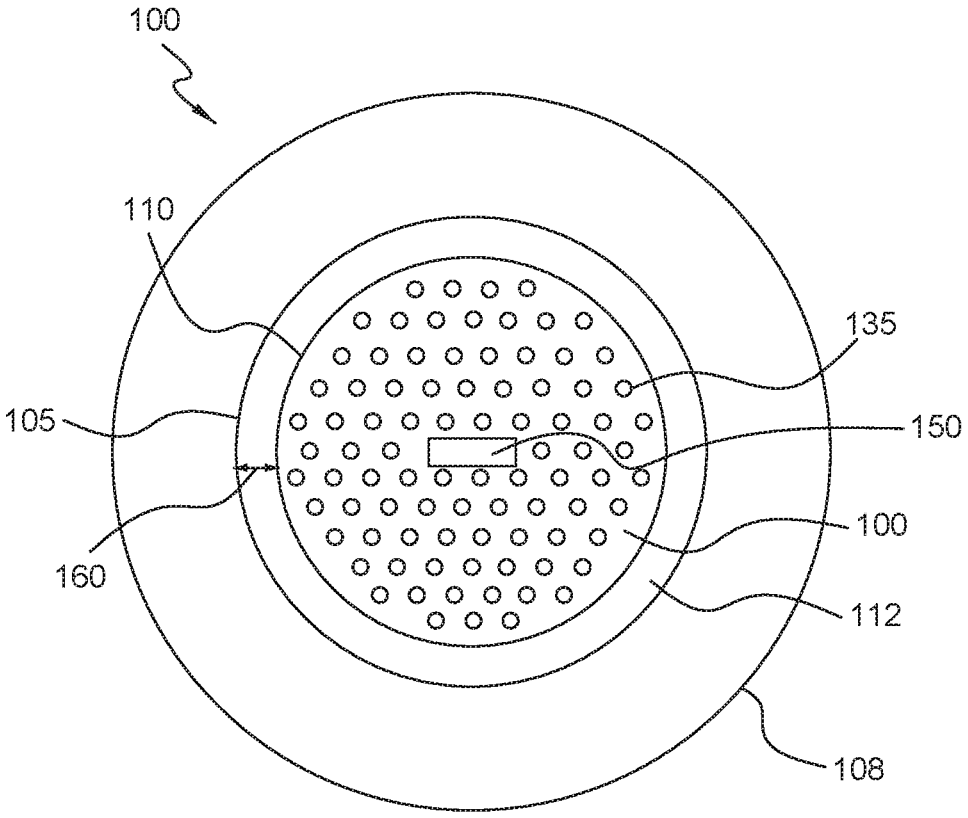
FIG. 2 illustrates an example top view block diagram of the example wood pellet burner unit of FIG. 1 in accordance with various embodiments of the inventive concept.

FIG. 2 illustrates an example top view block diagram of the example wood pellet burner unit 100 of FIG. 1 in accordance with various embodiments of the inventive concept. The top view is looking down into the wood pellet burner unit 100. The top view includes the outer housing 105, the rim assembly 108 of the outer housing 105, and the inner combustion vessel 110 having the upper resting flange 112. The air gap 160 is shown disposed between the outer housing 105 and the inner combustion vessel 110. It will be understood that the proportions of the drawing need not be as exactly depicted in FIG. 2, but rather, are for illustrative purposes. For example, the air gap 160 can be narrower or wider than shown. The grate 130 is shown disposed toward the bottom of the inner combustion vessel 110. The grate 130 includes the grate handle 150 and the grate orifices 135. The gate orifices 135 can be scattered throughout the grate 130 in a random or orderly pattern.

Figure 3:
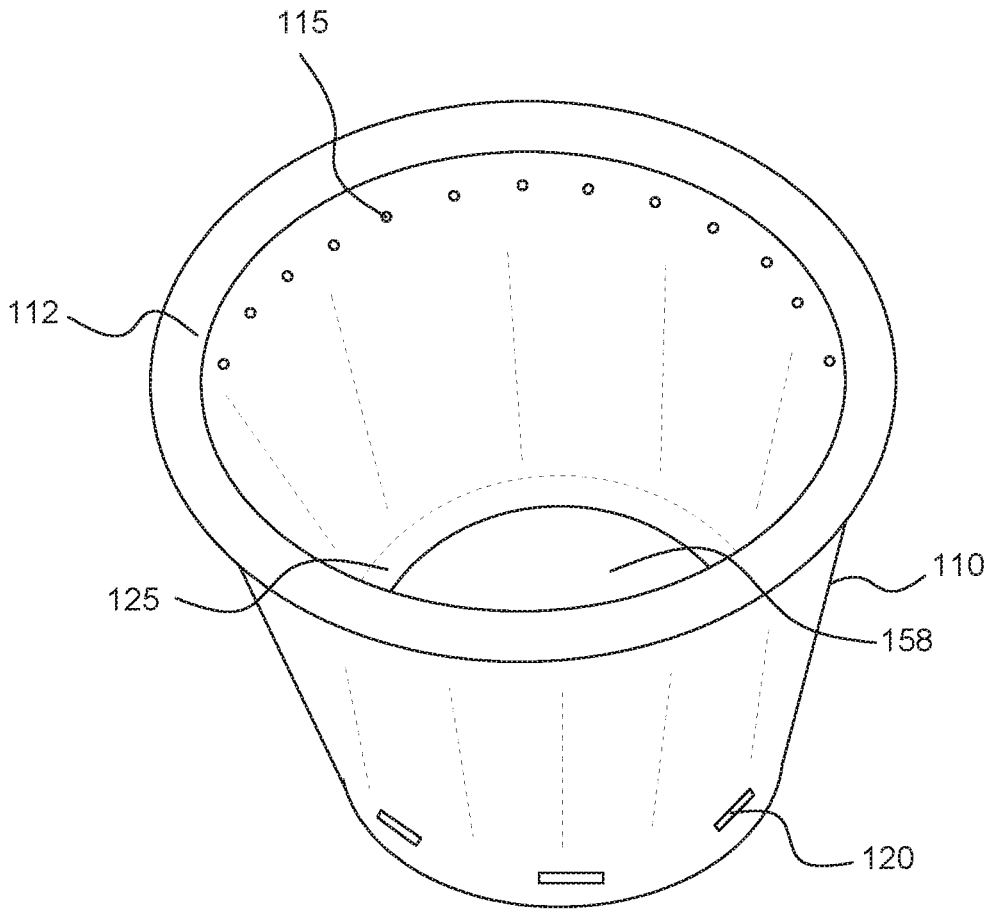
FIG. 3 illustrates an example perspective view of the inner combustion vessel of the wood pellet burner unit of FIG. 1 in accordance with various embodiments of the inventive concept.

FIG. 3 illustrates an example perspective view of the inner combustion vessel 110 of the wood pellet burner unit 100 of FIG. 1 in accordance with various embodiments of the inventive concept. The perspective view of FIG. 3 includes the upper vessel orifices 115 and the lower vessel apertures 120. The inner combustion vessel 110 can include an opening 158 at the bottom thereof. In addition, the upper resting flange 112 of the inner combustion vessel 110 is shown.

Figure 4:
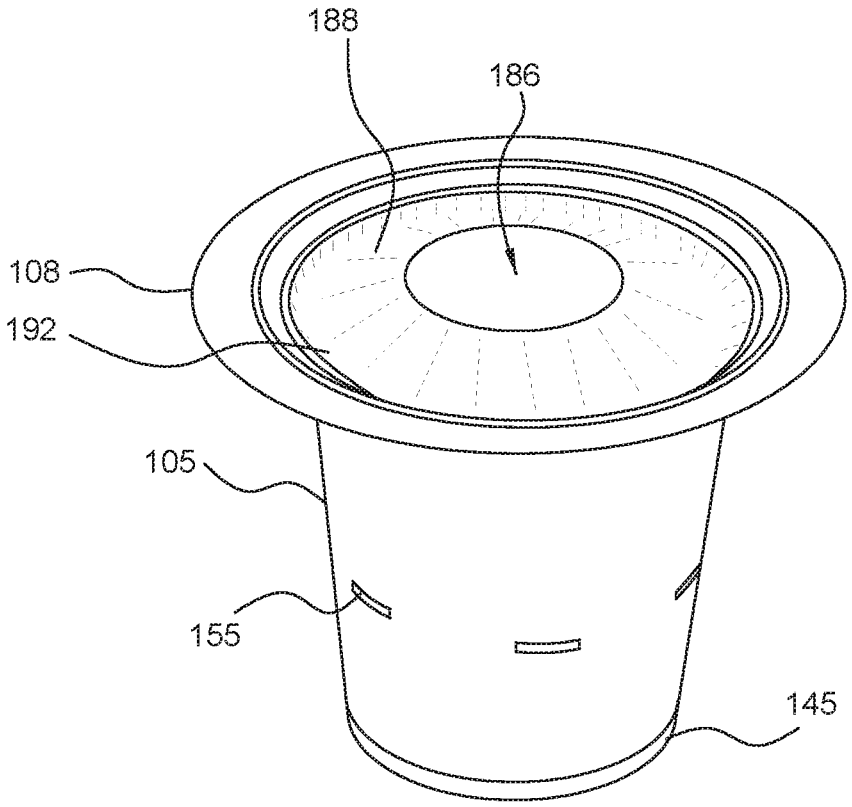
FIG. 4 illustrates an example perspective view of the outer housing of the wood pellet burner unit of FIG. 1 in accordance with various embodiments of the inventive concept.

FIG. 4 illustrates an example perspective view of the outer housing 105 of the wood pellet burner unit 100 of FIG. 1 in accordance with various embodiments of the inventive concept. The perspective view of FIG. 4 includes the rim assembly 108 of the outer housing 105, the flame guide 192, the air intake vents 155, and the outer insulation layer 145. The flame guide 192 can be substantially annular in shape with a central opening 86, and a convex outer region 188.

Figure 5:
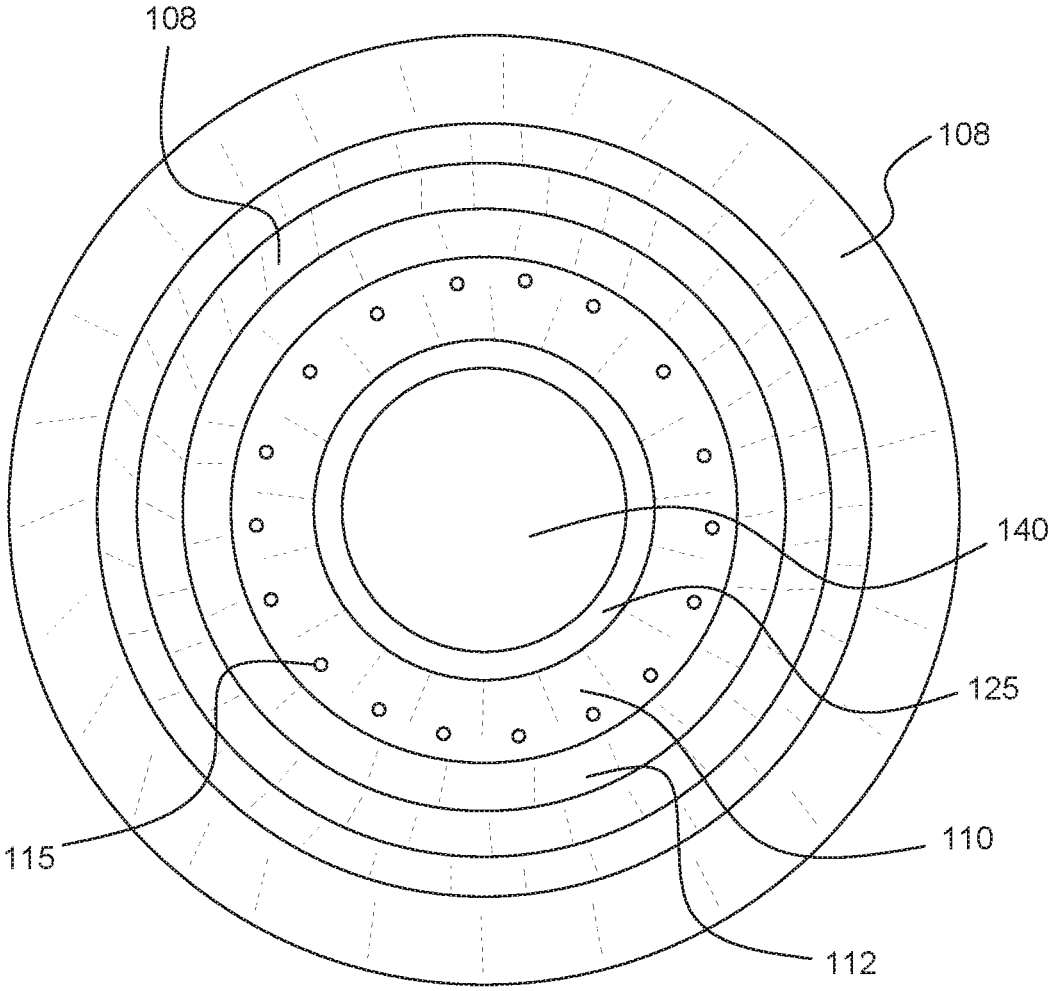
FIG. 5 illustrates an example top view of a rim assembly of the outer housing and the inner combustion vessel of the wood pellet burner unit of FIG. 1 in accordance with various embodiments of the inventive concept.

FIG. 5 illustrates an example top view of the rim assembly 108 of the outer housing 105 and the inner combustion vessel 110 of the wood pellet burner unit 100 of FIG. 1 in accordance with various embodiments of the inventive concept. The top view of FIG. 5 includes the rim assembly 108 of the outer housing 105, the upper vessel orifices 115 of the inner combustion vessel 110, the inner insulation layer 140 of the inner combustion vessel 110, and the grate support flange 125 of the inner combustion vessel 110. In addition, the upper resting flange 112 of the inner combustion vessel 110 is shown resting on the rim assembly 108 of the outer housing 105.

Figure 6:
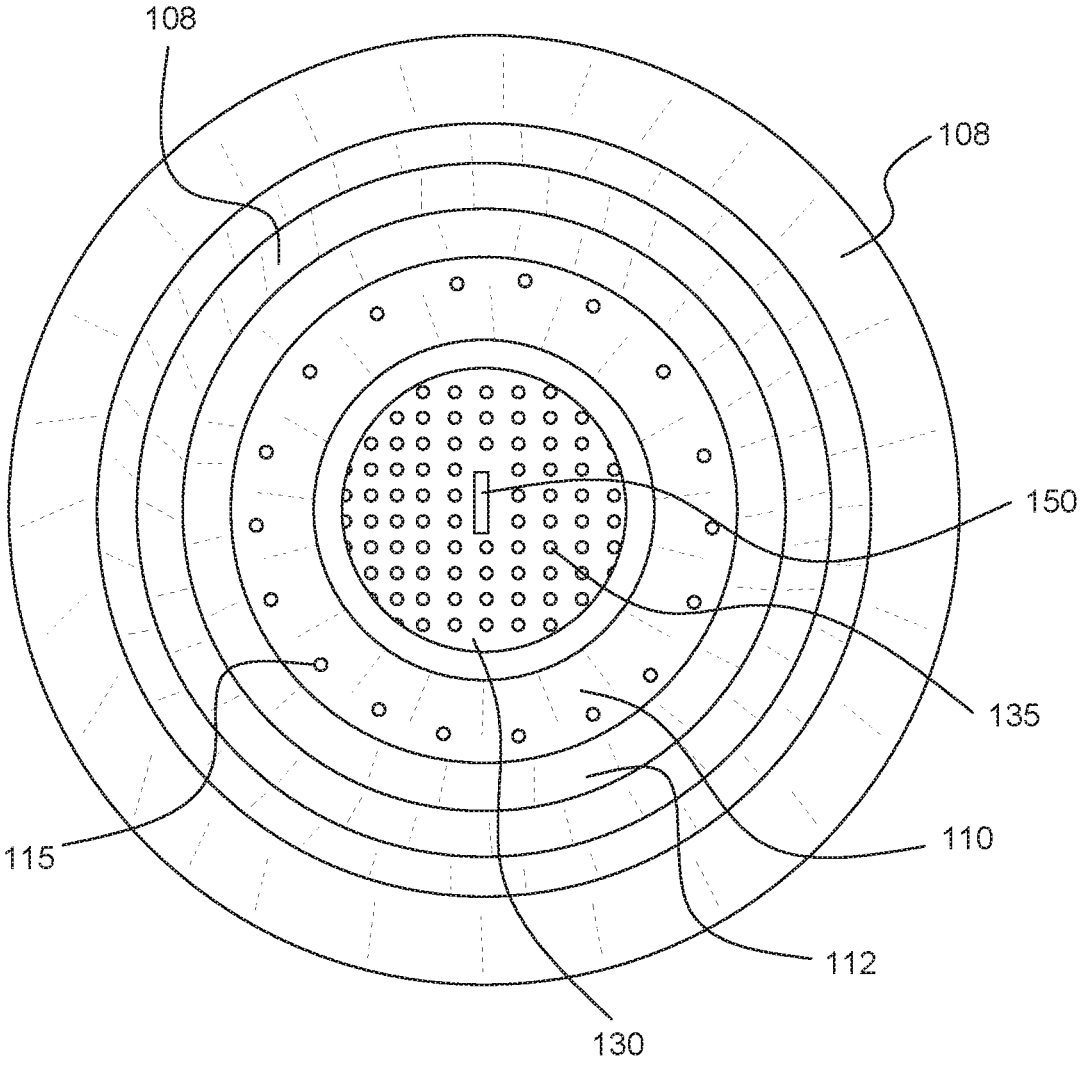
FIG. 6 illustrates an example top view of the rim assembly of the outer housing, the inner combustion vessel, and the grate of the wood pellet burner unit of FIG. 1 in accordance with various embodiments of the inventive concept.

FIG. 6 illustrates an example top view of the rim assembly 108 of the outer housing 105, the inner combustion vessel 110, and the grate 130 of the wood pellet burner unit 100 of FIG. 1 in accordance with various embodiments of the inventive concept. The top view of FIG. 6 shows the handle 150 of the grate 130, and the grate orifices 135 of the grate 130. The grate 130 can be removed from the bottom of the inner combustion vessel 110 by grasping of the handle 150 and lifting the grate 130 upwardly out of the inner combustion vessel 110. The grate 130 can be replaced into the inner combustion vessel 110 to rest atop the grate support flange 125 (of FIG. 5). Also shown in FIG. 6 are the upper vessel orifices 115 and the upper resting flange 112 of the inner combustion vessel 110.

Figure 7:
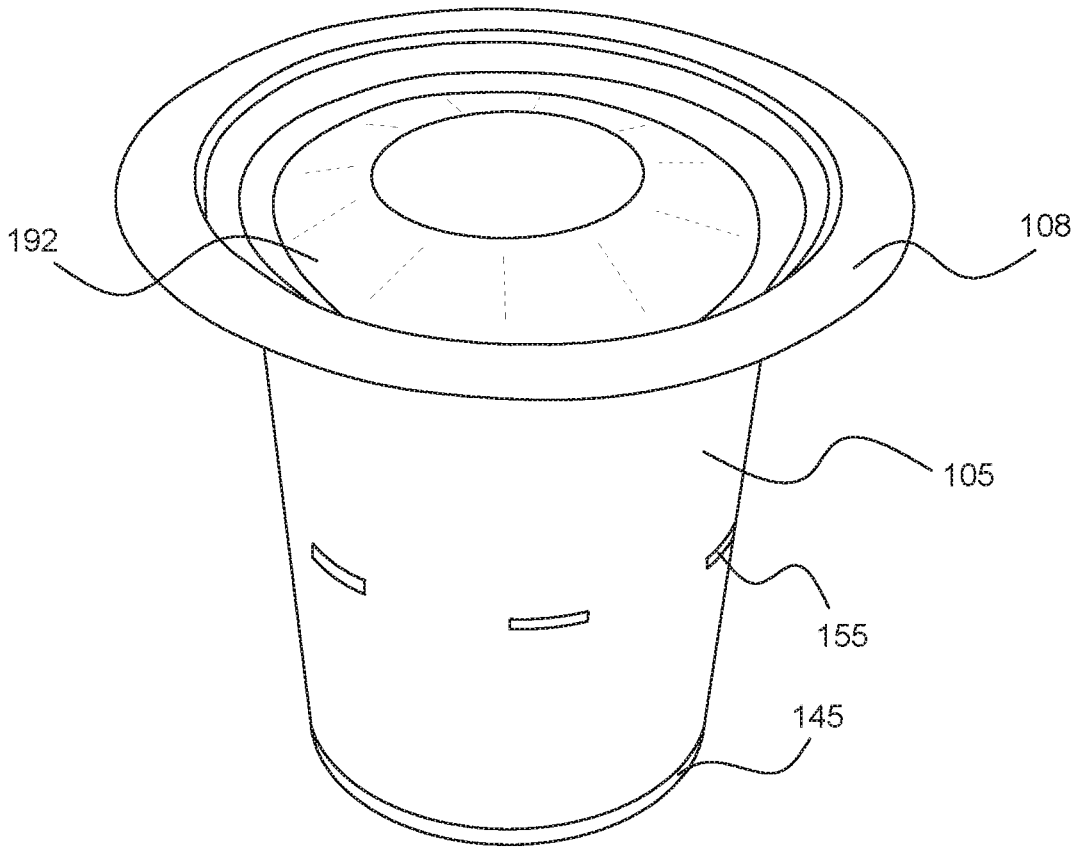
FIG. 7 illustrates an example perspective view of the outer housing of the wood pellet burner unit of FIG. 1, including the flame guide, in accordance with various embodiments of the inventive concept.

FIG. 7 illustrates an example perspective view of the outer housing 105 of the wood pellet burner unit of FIG. 1, including the flame guide 192, in accordance with various embodiments of the inventive concept. Also shown in FIG. 7 are the outer insulation layer 145, the outer housing rim assembly 108, and the air intake vents 155.

Figure 8:
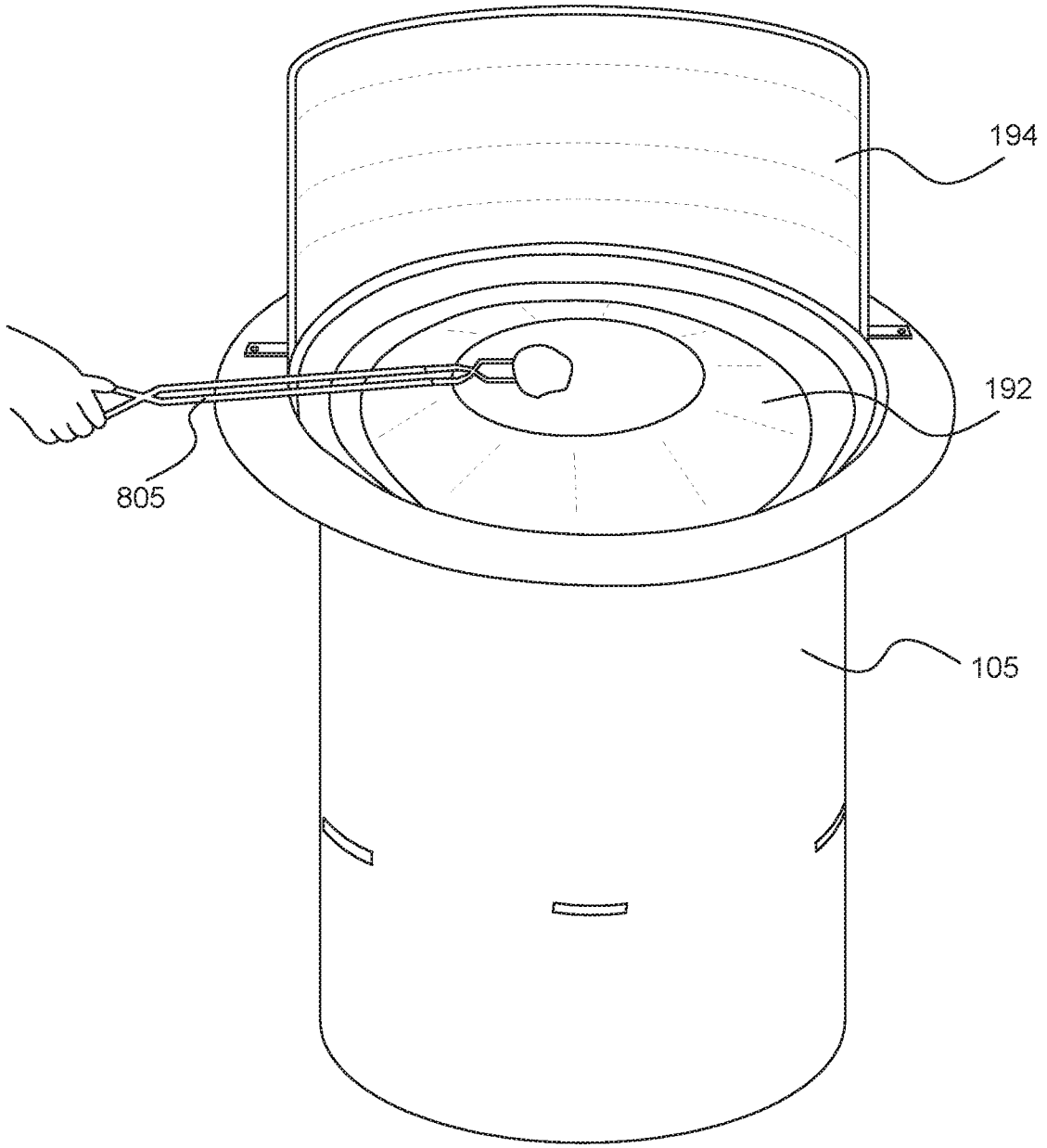
FIG. 8 illustrates an example perspective view of the outer housing of the wood pellet burner unit of FIG. 1, including the flame guide and the wind break radiant heat reflector, in accordance with various embodiments of the inventive concept.

FIG. 8 illustrates an example perspective view of the outer housing 105 of the wood pellet burner unit 100 of FIG. 1, including the flame guide 192 and the wind break radiant heat reflector 194, in accordance with various embodiments of the inventive concept. In addition, a roaster stick or rod 805 is shown, which can be used to roast food such as marsh mellows or hotdogs over the top opening of the flame guide 192. Such roasting can be conducted while the flames 196 (of FIG. 1) are tall and full and/or after the flames 196 have died down to the point where only heat is emanating from the interior of the inner combustion vessel 110.

Figure 9:
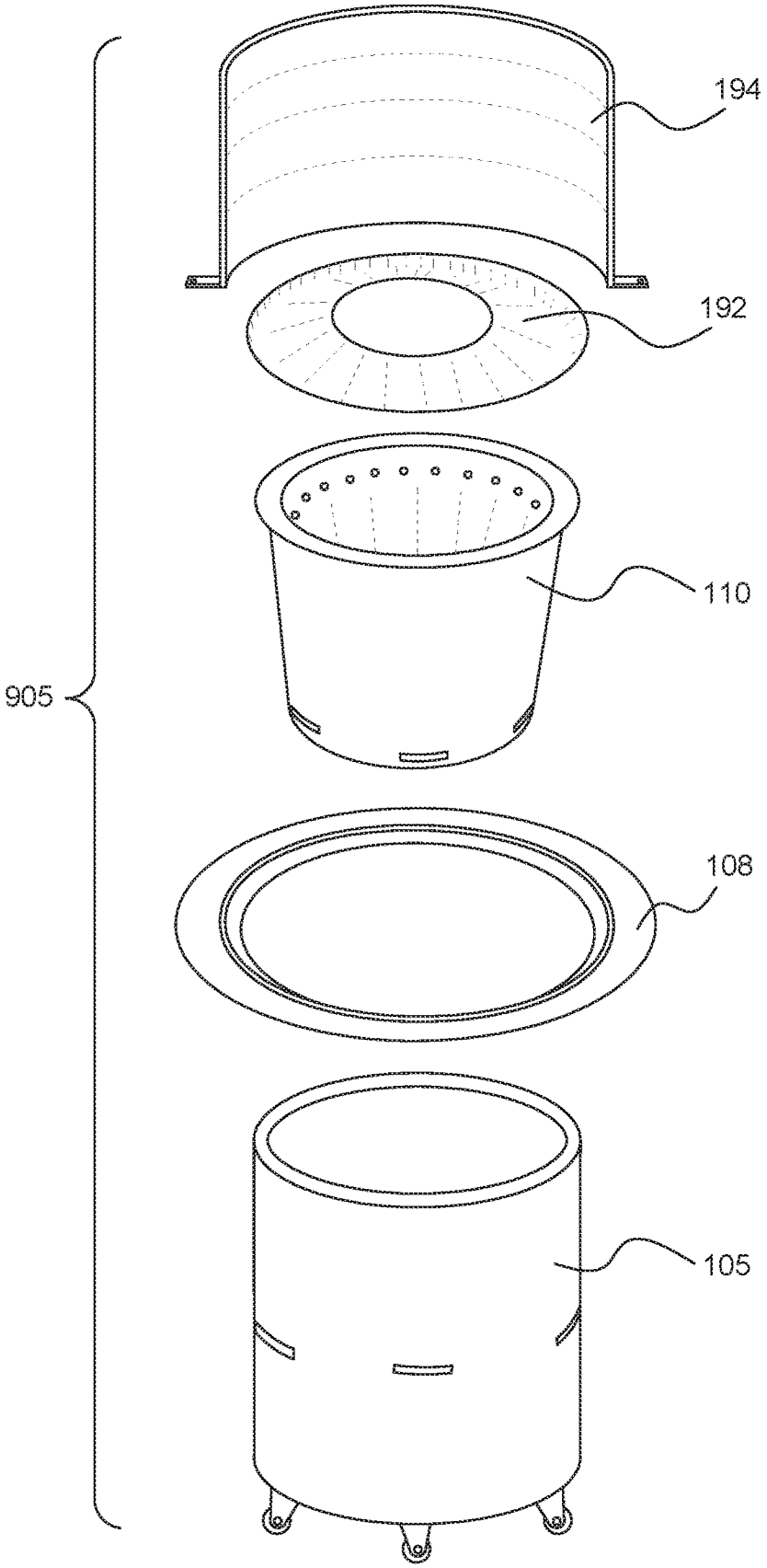
FIG. 9 illustrates an example exploded perspective view of the high-capacity, sparkless, mobile, double-insulated wood pellet burner unit in accordance with various embodiments of the inventive concept.

FIG. 9 illustrates an example exploded perspective view 905 of the high-capacity, sparkless, mobile, double-insulated wood pellet burner unit in accordance with various embodiments of the inventive concept. As shown in FIG. 9, the wood pellet burner unit 100 can include the outer housing 105. The outer housing rim assembly 108 can be disposed on the outer housing 105, or otherwise be part of the outer housing 105. The inner combustion vessel 110 can be placed within the outer housing 105. The flame guide 192 can be disposed on the outer housing rim assembly 108 over the inner combustion vessel 110. The wind break radiant heat reflector 194 can be disposed on the outer housing rim assembly 108 toward a side thereof.

Embodiments of the inventive concept disclosed herein include a high-capacity sparkless mobile double-insulated wood pellet burner unit. The wood pellet burner unit can include an outer housing including one or more air intake vents, an inner combustion vessel disposed within the outer housing, the inner combustion vessel including one or more lower vessel apertures and one or more upper vessel orifices, and an air gap disposed between the outer housing and the inner combustion vessel. The one or more intake vents can be configured to receive outside air. The air gap can be configured to divide the outside air into a first branch having downward flowing heated combustible air in the air gap, and a second branch having upward flowing heated combustible air in the air gap. The one or more lower vessel apertures can be configured to receive the heated combustible air from the first branch. The one or more upper vessel orifices can be configured to receive the heated combustible air from the second branch.

In some embodiments, the inner combustion vessel can include a grate support flange in a lower section thereof, and the grate support flange is configured to support a grate. The grate support flange can be located above a bottom end of the inner combustion vessel and below a mid-section of the inner combustion vessel. The grate can include one or more orifices through the grate thereof that are configured to receive the heated combustible air from the one or more lower vessel apertures. The grate can include a handle to facilitate insertion and removal of the grate into and out from the inner combustion vessel. The inner combustion vessel can be configured to hold wood pellets on the grate. The one or more orifices through the grate are of such size as to allow the heated combustible air to flow through the grate in an upward direction through the wood pellets to form a gasification of the wood pellets into wood pellet gases.

In some embodiments, the inner combustion vessel is configured to mix the wood pellet gases with the heated combustible air received through the one or more upper vessel orifices. The inner combustion vessel can be configured to hold up to 40 pounds of wood pellets. The wood pellet burner unit can further include an annular convex flame guide configured to cause the mixed wood pellet gases and the heated combustible air to form sparkless flames having a base at or near the upper vessel orifices. The outer housing can further comprise a circular rim assembly, wherein the rim assembly provides a safety barrier between small children and flames exiting an upper region of the wood pellet burner unit.

In some embodiments, the wood pellet burner unit can further comprise a wind break radiant heater reflector disposed on the rim assembly. The wind break radiant heater reflector can encircle substantially one half of a circumference of the rim assembly. The wind break radiant heater reflector can be configured to enhance the flames by shielding wind from the flames. The wind break radiant heater reflector can include a mirror-like finish on an inside surface thereof that is configured to reflect heat from the flames. Three or more casters can be attached beneath the outer housing.

In some embodiments, an inner insulation layer is disposed beneath the inner combustion vessel within the outer housing. In addition, an outer insulation layer that is spaced apart from the inner insulation layer, can be disposed on the outer insulation layer. The inner combustion vessel can include an annular upper resting flange configured to rest atop a rim assembly of the outer housing. The upper resting flange can be substantially flush with a top end of the inner combustion vessel. The one or more lower vessel apertures can include a plurality of rectangular apertures disposed around a circumference of a lower region of the inner combustion vessel. The one or more upper orifices can include a plurality of circular orifices disposed around a circumference of an upper region of the inner combustion vessel. In some embodiments, each of the lower vessel apertures has a larger area of opening than each of the upper vessel orifices.

Embodiments of the inventive concept can include a high-capacity sparkless mobile double-insulated wood pellet burner unit. The wood pellet burner unit can include an outer housing including a plurality of air intake vents, and a circular rim assembly, wherein the rim assembly provides a safety barrier to flames exiting a top region of the outer housing. The wood pellet burner unit can further include an inner combustion vessel disposed within the outer housing. The wood pellet burner unit can further include an annular convex flame guide disposed on the rim assembly, and configured to cause mixed wood pellet gases and heated combustible air from the plurality of air intake vents to form the flames having a base at or near a plurality of upper vessel orifices in the inner combustion vessel. The wood pellet burner unit can further include a wind break radiant heater reflector disposed on the rim assembly.

In some embodiments, the wind break radiant heater reflector encircles substantially one half of a circumference of the rim assembly. The wind break radiant heater reflector can be configured to enhance the flames by shielding wind from the flames. The wind break radiant heater reflector can include a mirror-like finish on an inside surface thereof that is configured to reflect heat from the flames.

The wood pellet burner unit can further include an air gap disposed between the outer housing and the inner combustion vessel. The inner combustion vessel can include a plurality of lower vessel apertures. The plurality of intake vents can be configured to receive outside air. The air gap can be configured to divide the outside air into a first branch having downward flowing heated combustible air in the air gap, and a second branch having upward flowing heated combustible air in the air gap. The plurality of lower vessel apertures can be configured to receive the heated combustible air from the first branch. The plurality of upper vessel orifices can be configured to receive the heated combustible air from the second branch. The inner combustion vessel can include a grate support flange in a lower section thereof, and the grate support flange is configured to support a grate. The grate can include a plurality of orifices through the grate thereof that are configured to receive the heated combustible air from the plurality of lower vessel apertures. The grate can include a handle to facilitate insertion and removal of the grate into and out from the inner combustion vessel. The inner combustion vessel can be configured to hold wood pellets on the grate. The plurality of orifices through the grate are of such size as to allow the heated combustible air to flow through the grate in an upward direction through the wood pellets to form a gasification of the wood pellets into wood pellet gases. The inner combustion vessel can be configured to mix the wood pellet gases with the heated combustible air received through the plurality of upper vessel orifices.

Having described and illustrated the principles of the inventive concept with reference to illustrated embodiments, it will be recognized that the illustrated embodiments can be modified in arrangement and detail without departing from such principles, and can be combined in any desired manner And although the foregoing discussion has focused on particular embodiments, other configurations are contemplated. In particular, even though expressions such as "according to an embodiment of the invention" or the like are used herein, these phrases are meant to generally reference embodiment possibilities, and are not intended to limit the inventive concept to particular embodiment configurations. As used herein, these terms can reference the same or different embodiments that are combinable into other embodiments.

Consequently, in view of the wide variety of permutations to the embodiments described herein, this detailed description and accompanying material is intended to be illustrative only, and should not be taken as limiting the scope of the inventive concept. What is claimed as the invention, therefore, is all such modifications as may come within the scope and spirit of the following claims and equivalents thereto.

The invention claimed is:

1. A high-capacity sparkless mobile double-insulated wood pellet burner unit, comprising:

an outer housing;

an inner combustion vessel disposed within the outer housing;

a horizontally oriented continuous planar disk inner insulation layer disposed beneath the inner combustion vessel within the outer housing, wherein the inner insulation layer extends at least from a first outer edge of the inner combustion vessel to a second outer edge of the inner combustion vessel, and wherein the first outer edge is situated opposite to the second outer edge;

a continuous planar disk outer insulation layer having no apertures therein, wherein the outer insulation layer is disposed beneath the entire inner combustion vessel and beneath the entire inner insulation layer, wherein the outer insulation layer is spaced apart from the inner insulation layer, and wherein the outer housing is disposed on the outer insulation layer; and an air pap disposed between the outer housing and the inner combustion vessel, wherein:

the outer housing includes one or more air intake vents;

the one or more intake vents are disposed in the outer housing midway between a top of the outer housing and a bottom of the outer housing;

the one or more intake vents are configured to receive outside air;

the inner combustion vessel includes one or more lower vessel apertures and one or more upper vessel orifices;

the air pap is configured to divide the outside air into a first branch having downward flowing heated combustible air in the air gap, and a second branch having upward flowing heated combustible air in the air pap;

the one or more lower vessel apertures are configured to receive the heated combustible air from the first branch;

the one or more upper vessel orifices are configured to receive the heated combustible air from the second branch to feed sparkless flames having a base at or near the upper vessel orifices; and each of the lower vessel apertures has a larger area of opening than each of the upper vessel orifices.

2. The high-capacity sparkless mobile double-insulated wood pellet burner unit of claim 1, further comprising:

a grate;

wherein:

the inner combustion vessel includes an annular grate support flange in a lower section thereof, and the annular grate support flange is configured to support the grate;

the grate includes one or more orifices through the grate thereof that are configured to receive the heated combustible air from the one or more lower vessel apertures;

the inner combustion vessel is configured to hold wood pellets on the grate; and the one or more orifices through the grate are of such size as to allow the heated combustible air to flow through the grate in an upward direction through the wood pellets to form a gasification of the wood pellets into wood pellet gases.

3. The high-capacity sparkless mobile double-insulated of claim 2, wherein the annular grate support flange is located above a bottom end of the inner combustion vessel and below a mid-section of the inner combustion vessel.

4. The high-capacity sparkless mobile double-insulated wood pellet burner unit of claim 2, wherein the one or more orifices through the grate are configured to allow the first branch of the combustible air to flow through the grate in the upward direction through the wood pellets.

5. The high-capacity sparkless mobile double-insulated wood pellet burner unit of claim 1, further comprising:

a grate having the shape of a disk;

wherein:

the grate includes a single handle coupled to a center of the disk of the grate to facilitate insertion and removal of the grate into and out from the inner combustion vessel;

the inner combustion vessel is configured to mix wood pellet gases with the heated combustible air received through the one or more upper vessel orifices; and further comprising:

an annular convex flame guide configured to cause the mixed wood pellet gases and the heated combustible air to form the sparkless flames having the base at or near the upper vessel orifices, wherein the annular convex flame guide includes a continuous surface that surrounds a singular central aperture.

6. The high-capacity sparkless mobile double-insulated wood pellet burner unit of claim 1, wherein the one or more lower vessel apertures include a plurality of horizontally oriented rectangular apertures disposed around a circumference of a lower region of the inner combustion vessel.

7. The high-capacity sparkless mobile double-insulated wood pellet burner unit of claim 1, wherein the one or more upper orifices include a plurality of circular orifices disposed around a circumference of an upper region of the inner combustion vessel, and wherein the wood pellet burner unit further comprises the sparkless flames each having the base at or near a corresponding one of the upper vessel orifices.

8. The high-capacity sparkless mobile double-insulated wood pellet burner unit of claim 1, wherein the inner combustion vessel is configured to hold up to 40 pounds of wood pellets.

9. The high-capacity sparkless mobile double-insulated wood pellet burner unit of claim 1, wherein the outer housing further comprises a circular rim assembly along a circumference of the outer housing, wherein the rim assembly extends outward and provides a continuous vertical safety barrier between small children and flames exiting an upper region of the wood pellet burner unit.

10. The high-capacity sparkless mobile double-insulated wood pellet burner unit of claim 9, further comprising a wind break radiant heater reflector disposed on the rim assembly, wherein:

the wind break radiant heater reflector encircles substantially one half of a circumference of the rim assembly;

the wind break radiant heater reflector is configured to enhance the flames by shielding wind from the flames; and the wind break radiant heater reflector includes a mirror-like finish on an inside surface thereof that is configured to reflect heat from the flames.

11. The high-capacity sparkless mobile double-insulated wood pellet burner unit of claim 1, further comprising three or more swivel casters attached beneath the outer housing for easy and convenient movement of the wood pellet burner unit.

12. The high-capacity sparkless mobile double-insulated wood pellet burner unit of claim 1, further comprising a circular rim assembly along a circumference of the outer housing, wherein the inner combustion vessel includes an annular upper resting flange configured to rest atop the rim assembly of the outer housing, and wherein the annular upper resting flange only extends outward perpendicular to a vertical wall of the inner combustion vessel.

13. The high-capacity sparkless mobile double-insulated wood pellet burner unit of claim 12, wherein the upper resting flange has a same elevation as a top end of the inner combustion vessel.

14. The high-capacity sparkless mobile double-insulated wood pellet burner unit of claim 1, wherein the air gap is a single contiguous air gap disposed between the outer housing and the inner combustion vessel.

15. The high-capacity sparkless mobile double-insulated wood pellet burner unit of claim 1, wherein:

the inner combustion vessel is cylindrical having a first diameter;

the outer housing is cylindrical having a second diameter greater than the first diameter;

the air gap that separates a vertical wall of the inner combustion vessel from a vertical wall of the outer housing is annular; and the air gap that separates the vertical wall of the inner combustion vessel from the vertical wall of the outer housing is empty space.

* * * * *